US011440699B2

(12) United States Patent
Christino

(10) Patent No.: US 11,440,699 B2
(45) Date of Patent: Sep. 13, 2022

(54) SYSTEM, APPARATUS AND METHOD OF REDUCING OR ELIMINATING DAMAGE TO PRODUCT DURING STORAGE AND SHIPMENT

(71) Applicant: Alanric Food Distributors, Inc., West Deptford, NJ (US)

(72) Inventor: Maurice Christino, West Depford, NJ (US)

(73) Assignee: ALANRIC FOOD DISTRIBUTORS, INC., West Deptford, NJ (US)

( * ) Notice: Subject to any disclaimer, the term of this patent is extended or adjusted under 35 U.S.C. 154(b) by 0 days.

(21) Appl. No.: 17/118,791

(22) Filed: Dec. 11, 2020

(65) Prior Publication Data

US 2021/0179316 A1 Jun. 17, 2021

Related U.S. Application Data

(60) Provisional application No. 62/947,813, filed on Dec. 13, 2019.

(51) Int. Cl.
*B65D 5/50* (2006.01)

(52) U.S. Cl.
CPC ..... *B65D 5/5038* (2013.01)

(58) Field of Classification Search
CPC .... B65D 5/5059; B65D 5/5038; B65D 5/504; B65D 5/5035; B65D 5/5042; B65D 5/5052; B65D 5/505; B65D 71/72; B65D 85/305; B65D 85/30; B65D 85/34; B65D 85/32; B65D 85/321; B65D 85/322; B65D 85/324; B65D 85/325; B65D 85/328; B65D 85/327; B65G 49/061
USPC ..... 206/418, 551, 576, 45.25, 45.24, 736
See application file for complete search history.

(56) References Cited

U.S. PATENT DOCUMENTS 914,030 A * 3/1909 Eddy ..... B65D 85/325 211/14
1,179,845 A * 4/1916 Lange ..... B65D 85/321 217/26
1,673,956 A * 6/1928 Barnes ..... B65D 5/5045 206/433
2,574,983 A * 11/1951 Reed ..... B65D 85/305 206/139

(Continued)

FOREIGN PATENT DOCUMENTS

FR 3082189 A1 * 12/2019 ..... B65D 5/5061

*Primary Examiner* — King M Chu
*Assistant Examiner* — Prince Pal
(74) *Attorney, Agent, or Firm* — Mark T. Vogelbacker; Eckert Seamans Cherin & Mellott, LLC

(57) ABSTRACT

A container for packaging can include an insert removably inserted therein. The insert can include a planar first layer proximate a bottom of the box. The first layer can include a plurality of cut-outs extending therethrough. A second layer can be spaced-apart from the first layer. The second layer can include a central portion, a first wing, and a second wing. The central portion of the second layer can be positioned between the first wing and the second wing of the second layer. A third layer can be spaced-apart from the second layer. The third layer can include a central portion, a first wing, and a second wing. The central portion of the third layer can be positioned between the first wing and the second wing of the third layer.

9 Claims, 5 Drawing Sheets

(56) References Cited

U.S. PATENT DOCUMENTS

| | | | | | |
|---|---|---|---|---|---|
| 3,160,306 | A * | 12/1964 | Smalley | B65D 85/305 | 220/512 |
| 3,752,301 | A * | 8/1973 | Bluemel | B65D 5/5045 | 206/583 |
| 4,671,405 | A * | 6/1987 | Hagan | B65D 85/305 | 206/139 |
| 5,720,390 | A * | 2/1998 | Bostelman | B65D 5/5038 | 206/589 |
| 8,091,705 | B1 * | 1/2012 | McCutchen | B65D 5/5061 | 206/763 |
| D871,924 | S * | 1/2020 | Vanderwell | D9/755 | |
| 10,669,195 | B2 * | 6/2020 | Abbott, Jr. | B08B 9/42 | |
| 2010/0326858 | A1 * | 12/2010 | Williams | B65D 85/305 | 206/429 |
| 2013/0008817 | A1 * | 1/2013 | Colligan | B65D 5/5059 | 206/419 |
| 2014/0363555 | A1 * | 12/2014 | Simpson | B65D 5/5038 | 426/420 |
| 2019/0177031 | A1 * | 6/2019 | Vanderwell | B65D 5/5038 | |

* cited by examiner

SYSTEM, APPARATUS AND METHOD OF REDUCING OR ELIMINATING DAMAGE TO PRODUCT DURING STORAGE AND SHIPMENT

CROSS-REFERENCE TO RELATED APPLICATION

The present application claims priority to U.S. Provisional Patent Application No. 62/947,813, filed Dec. 13, 2019 and titled "SYSTEM, APPARATUS AND METHOD OF REDUCING OR ELIMINATING DAMAGE TO PRODUCT DURING STORAGE AND SHIPMENT," the entire disclosure of which is hereby incorporated by reference in its entirety.

FIELD

The presently disclosed technology relates to storing or shipping product, such as foodstuff and the like. More particularly, the presently disclosed technology relates to reducing or eliminating damage to product and/or its packaging during storage or shipment, such as by holding product and/or its packaging in place (e.g., no or little relative movement) with respect the container into which the product and/or its packaging is placed.

BACKGROUND AND DESCRIPTION OF RELATED ART

Containers, and particularly cardboard boxes, are commonly used to store and/or ship product, such as metal cans for holding foodstuff.

Conventional containers, while beneficial, can have numerous drawbacks. For example, product stored or shipped in prior art containers can be easily damaged. Certain prior art containers use a significant amount of material (e.g., bubble wrap or Styrofoam) to attempt to eliminate, or at least reduce, the damage by preventing the container within the container from moving with respect to the container. Even if this material is able to reduce the damage and/or relative movement, it creates a significant amount of waste that can be difficult or impossible to recycle. Further, the material can create a mess and/or be a hassle when the recipient of the container attempts to remove the product from the container.

BRIEF SUMMARY

There is a need to reduce the damage that occurs to product stored and/or shipped in containers. There is also a need to reduce the amount of waste generated when reducing or eliminating damage to product within a container.

The above and other needs are addressed by the presently disclosed technology, which includes, in one aspect, a container having an insert with at least one layer. The at least one layer can include one or a plurality of spaced-apart cut-outs configured to receive at least a portion of a product therein, thereby spacing the product from sidewalls of the container.

In another aspect, the presently disclosed technology can include a method of preventing or reducing cans from being damaged during storage or shipping. In one embodiment, the method can place each can in a cut-out formed in one or more layers placed within a container.

Optionally, in any embodiment, each product can be, contain, or hold any of a variety of materials, such as a liquid (e.g., juice), a solid, a semi-solid (e.g., tomatoes), or a gas (e.g., air freshener).

In one optional embodiment, the presently disclosed technology is directed to a system configured to store or ship a plurality of cans without causing damage to the cans or product therein. The system can include a cardboard box and an insert that can be placed into and removed from the box. The insert can include a first layer proximate a bottom of the box. The first layer can be planar. The first layer can include a plurality of circular, spaced-apart cut-outs extending therethrough. Each cut-out in the first layer can have a diameter that is slightly larger than a diameter of one of the plurality of cans. The insert can include a second layer spaced-apart above the first layer. The second layer can include a central portion, a first wing, and a second wing. The central portion of the second layer can be positioned between the first wing and the second wing of the second layer. When the insert is placed into the box the first and the second wings of the second layer can each extend at an angle with respect to the central portion of the second layer. The second layer can include a plurality of circular, spaced-apart cut-outs extending through the central portion thereof. Each cut-out in the second layer can be located in the central portion thereof. Each cut-out in the second layer can have a diameter that is slightly larger than a diameter of one of the plurality of cans. The insert can include a third layer spaced-apart above the second layer. The third layer can include a central portion, a first wing, and a second wing, the central portion of the third layer can be positioned between the first wing and the second wing of the third layer. When the insert is placed into the box the first and the second wings of the third layer can each extend at an angle with respect to the central portion of the third layer. The third layer can include a plurality of circular, spaced-apart cut-outs extending through the central portion thereof. Each cut-out in the third layer can be located in the central portion thereof. Each cut-out in the second layer can have a diameter that is slightly larger than a diameter of one of the plurality of cans. Wherein, when the insert is placed into the box, the insert can extend an entire width and length of an interior of the box. Wherein, when the insert is placed into the box, each cut-out in the third layer can be vertically aligned with one of the plurality of cut-outs in each of the second layer and the first layer such that one can of the plurality of cans can be inserted into a trio of vertically aligned cut-outs to prevent the can from moving relative to the box.

BRIEF DESCRIPTION OF THE DRAWINGS

The foregoing summary, as well as the following detailed description of the presently disclosed technology, will be better understood when read in conjunction with the appended drawings, wherein like numerals designate like elements throughout. For the purpose of illustrating the presently disclosed technology, there are shown in the drawings various illustrative embodiments. It should be understood, however, that the presently disclosed technology is not limited to the precise arrangements and instrumentalities shown. In the drawings.

DETAILED DESCRIPTION

Figure 1:
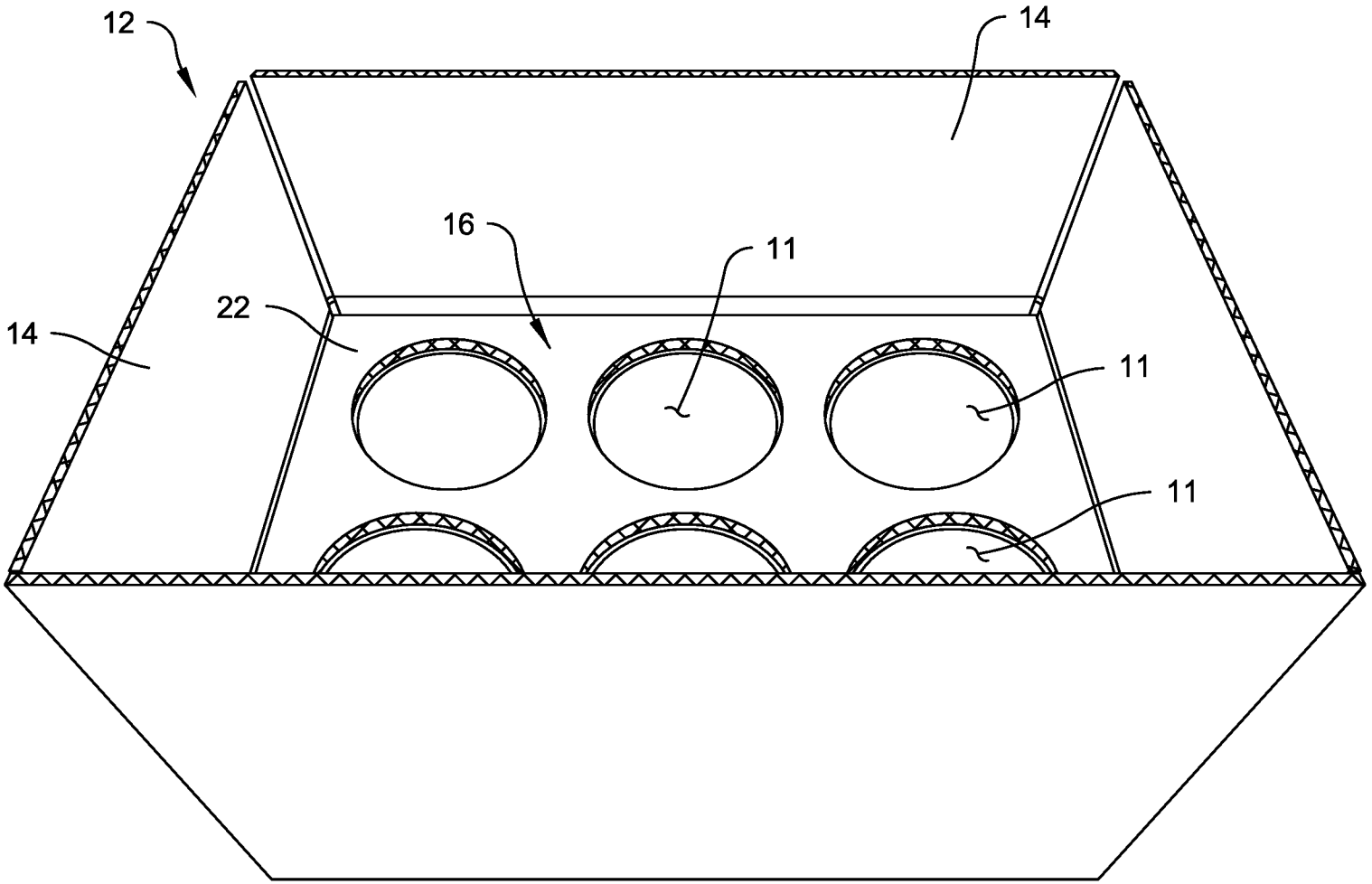
FIG. 1 is a top perspective view of a container according to one embodiment of the presently disclosed technology, wherein the container is in an open configuration and includes product and/or its packaging therein.

While systems, devices and methods are described herein by way of examples and embodiments, those skilled in the art recognize that the presently disclosed technology is not limited to the embodiments or drawings described. Rather, the presently disclosed technology covers all modifications, equivalents and alternatives falling within the spirit and scope of the appended claims. Features of any one embodiment disclosed herein can be omitted or incorporated into another embodiment.

Any headings used herein are for organizational purposes only and are not meant to limit the scope of the description or the claims. As used herein, the word "may" is used in a permissive sense (i.e., meaning having the potential to) rather than the mandatory sense (i.e., meaning must). Unless specifically set forth herein, the terms "a," "an" and "the" are not limited to one element but instead should be read as meaning "at least one." The terminology includes the words noted above, derivatives thereof and words of similar import.

Referring now in detail to the various figures, wherein like reference numerals refer to like parts throughout, FIGS. 1-6 illustrate one embodiment of a system, apparatus and method for reducing or eliminating damage to product and/or its packaging during storage and/or shipment thereof. Alternatively or additionally, the system, apparatus and method relate to preserving product and/or its packaging during storage and/or shipment.

In one embodiment, the packaging 11 can be one or a plurality of evenly spaced-apart cylindrical, metal cans for containing product, such as foodstuff, e.g., tomatoes. FIG. 1 depicts the packaging 11 as cylinders, wherein a diameter thereof is less than a height thereof. However, the packaging 11 is not so limited, as the packaging 11 can have a different shape, be formed of a different material, and/or contain different product. For example, the packaging 11 can be glass bottles containing, e.g., wine, or plastic containers for containing cottage cheese, yogurt, or a non-perishable substance.

Figure 2:
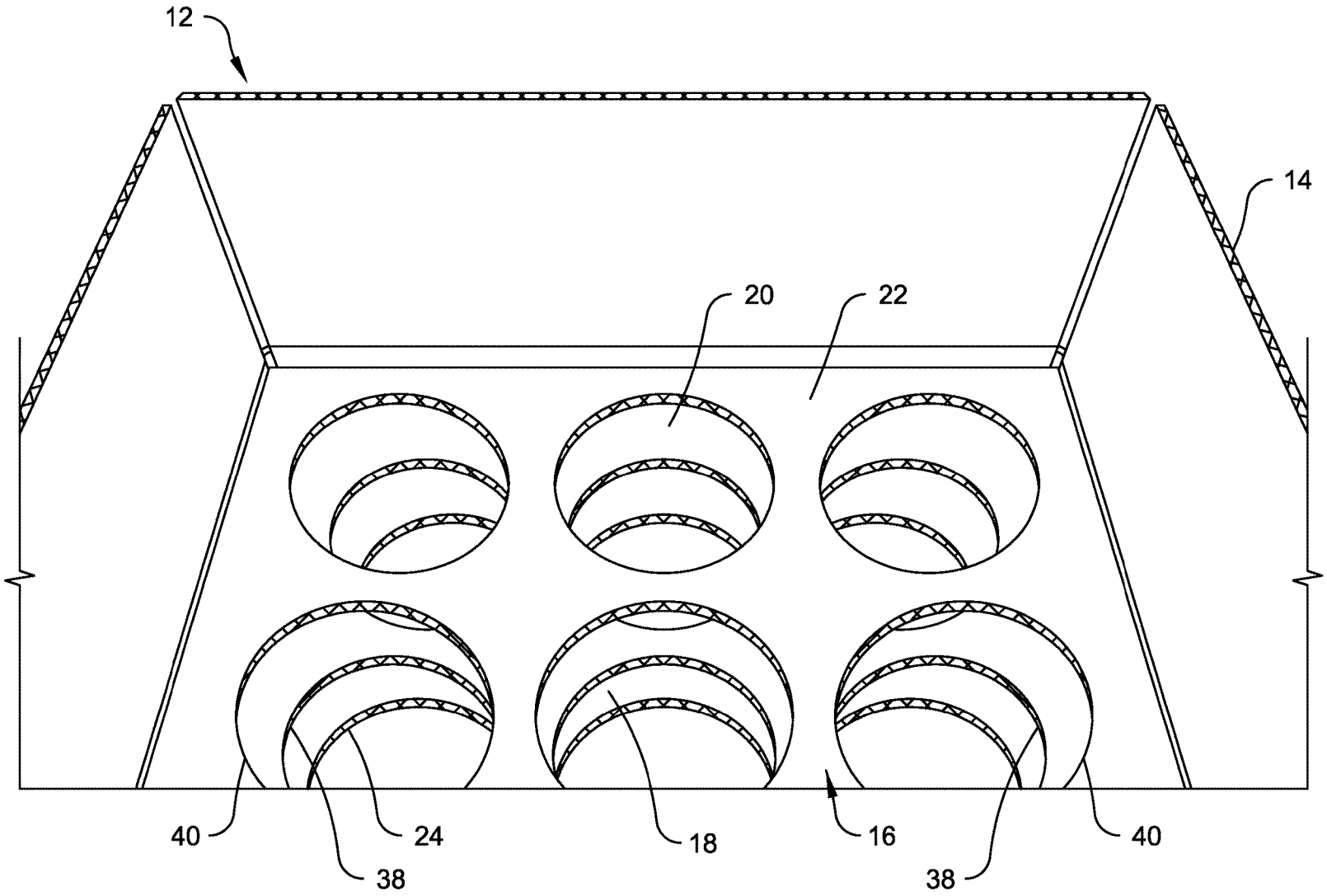
FIG. 2 is another, slightly magnified top perspective view of the container of FIG. 1, wherein the product and/or its packaging has been removed for clarity.
Figure 3:
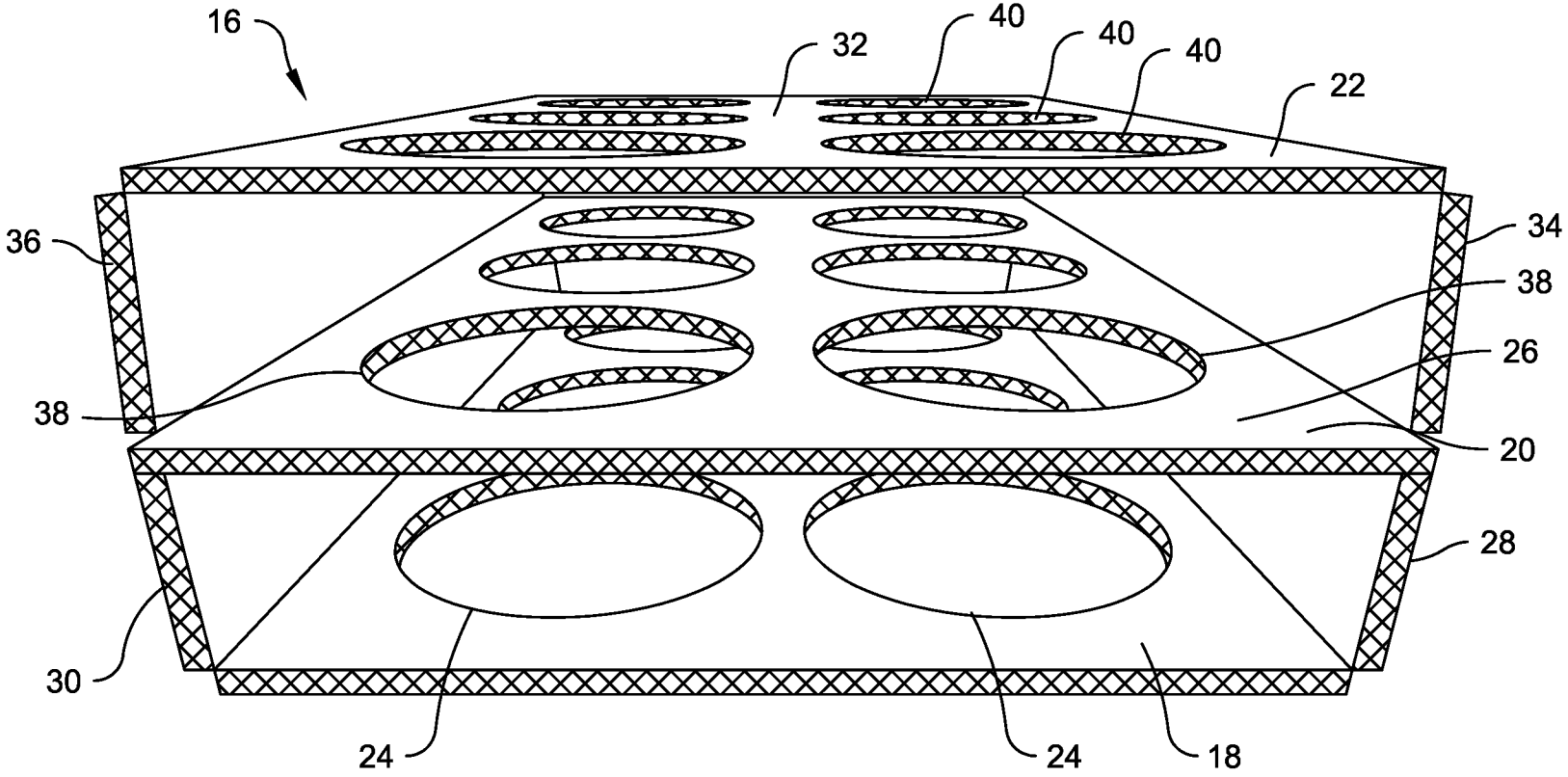
FIG. 3 is a side perspective view of an insert or layers of the container of FIG. 1.
Figure 4:
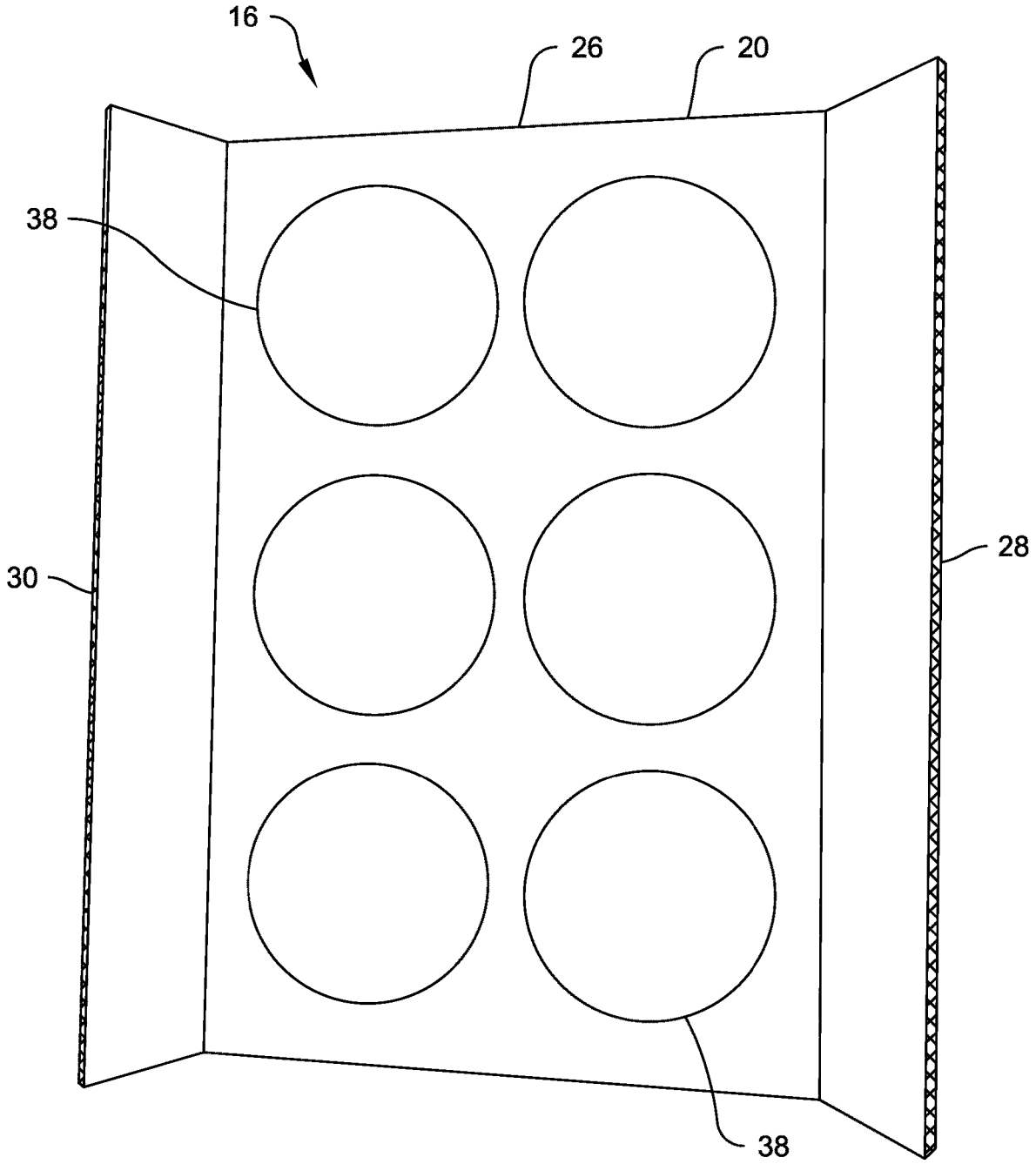
FIG. 4 is a bottom perspective view of a portion of the insert or one of the layers shown in FIG. 3.
Figure 5:
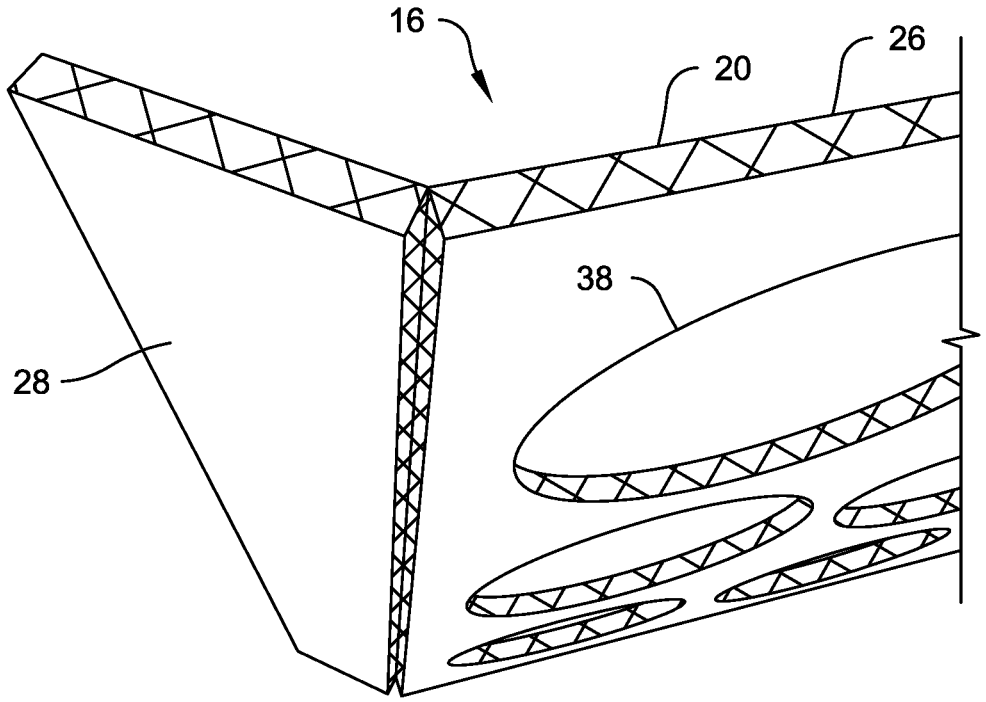
FIG. 5 is a magnified view of at least a portion of the insert or one of the layers shown in FIG. 3.
Figure 6:
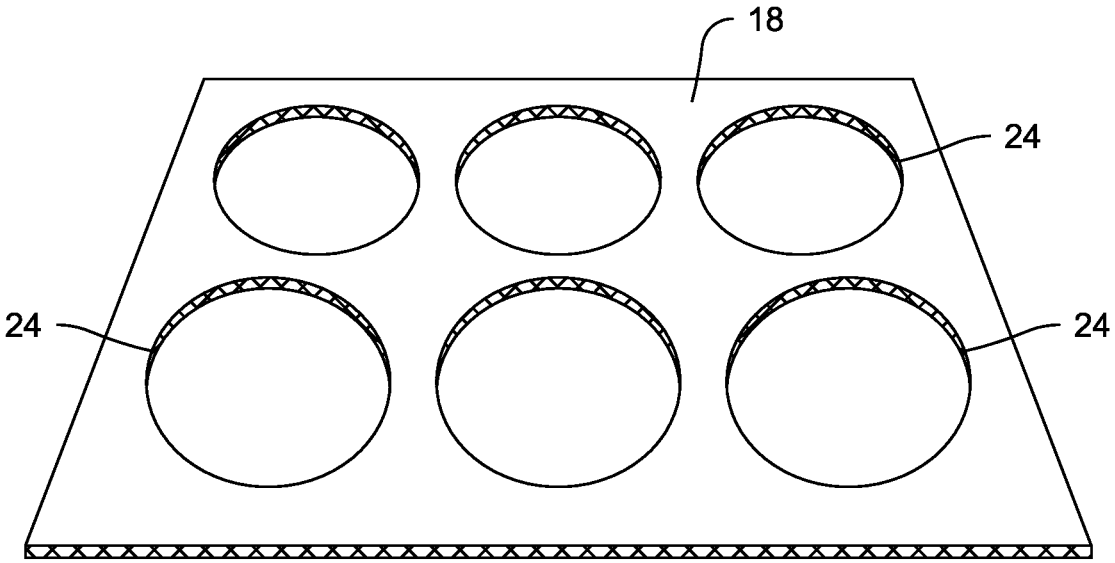
FIG. 6 is a perspective view of a portion of the insert or one of the layers shown in FIG. 3.

Optionally, the system employs a container or box, generally designated 12. The box 12 can be formed of cardboard, such as corrugated cardboard (wherein the corrugation is depicted in the drawings by a plurality of "x"), but the presently disclosed technology is not limit to such material. For example, the box 12 can be formed of a polymeric or metallic material, for example. The box 12 is shown in FIGS. 1 and 2 as having a rectangular shape with at least a bottom and four walls, but the presently disclosed technology is not limited to such a shape. For example, the box 12 can be formed as a square or a cylinder, for example.

The box 12 can optionally include a plurality (e.g., two or four) upper flaps 14 that can be configured to close an upper opening of the box 12. However, other options are possible. For example, alternatively, the box 12 can include a removable or separable lid, or one or fewer than four upper flaps.

In one embodiment, the box 12 can include a means for supporting or an insert, generally designated 16, for holding, containing, and/or supporting one or more of the packaging 11. The means for supporting or the insert 16 can be removably attachable to, and removably insertable into, the box 12. The insert 16 can match or conform to the interior shape of the box 12. Optionally, the insert 16 can extend the entire length, width, and/or diameter of the interior of the box 12, such that the insert 16 does not move with respect to the box 12 when the insert 16 is placed into the box 12.

Optionally, the means for supporting or the insert 16 can include at least one or a plurality of vertically spaced-apart layers. Optionally, one or more or at least a portion of each layer is flat or planar. More particularly, in one embodiment, the means for supporting or the insert 16 can include a first or bottom layer 18, a second or middle layer 20, and a third or top layer 22. The presently disclosed technology is not limited to the insert 16 including a particular number of layers, as the layers can be reduced or increased depending upon the particular needs or circumstances. Also, a thickness of each layer can be increased or decreased from that shown in figures.

In one optional embodiment, the first layer 18 can be positioned proximate a bottom of the box 12. The first layer 18 can optionally be entirely planar or flat such that it only extends in one plane. The first layer 18 can include at least one or a plurality of (e.g., six) spaced-apart cut-outs 24 or openings extending therethrough. Optionally, each cut-out 24 can have a circular shape. However, the shape of each cut-out 24 can be configured to match or be at least slightly larger than an outer dimension of one of the packaging 11. For example, each cut-out 24 includes an opening or passageway having a diameter or width that is slightly larger than a diameter or width of one of the plurality of products 11.

In one optional embodiment, the second layer 20 can be spaced-apart from (e.g., positioned above a predetermined distance) the first layer 18. The second layer 20 can optionally include a central portion 26, a first wing 28, and a second wing 30. The central portion 26 of the second layer 20 can be positioned between the first wing 28 and the second wing 30 of the second layer 20. In use, in one embodiment, a plane in which the central portion 26 extends is different from a plane in which the first and second wings 28, 30 extend. More particularly, in one embodiment, the first and second wings 28, 30 extend at an angle of exactly 90°, or between 85-95°, or between 80-100°, or between 70-110°, with respect to the central portion 26. Such a configuration spaces the central portion 26 of the second layer 20 from the first layer 18, which allows the insert 16 to better secure the product 11.

In one optional embodiment, the second layer 20 can initially be formed from an entirely flat piece of material (e.g., cardboard). Optionally, the first and second wings 28, 30 thereof can be formed by at least partially scoring (e.g., see FIG. 5) or perforating two straight lines through opposing portions of the material, and then folding or bending first and second wings 28, 30 with respect to the central portion 26.

Similar to the first layer 18, the second layer 20 can include at least one or a plurality of (e.g., six) spaced-apart cut-outs 38 or openings extending therethrough. Optionally, each cut-out 38 can have a circular shape. However, the shape of each cut-out 38 can be configured to match or be at least slightly larger than an outer dimension of one of the products 11. For example, each cut-out 38 includes an opening or passageway having a diameter or width that is slightly larger than a diameter or width of one of the plurality of products 11. When placed in the box 12, each cut-out 24 of the first layer 18 can be vertically aligned with one of the cut-outs 38 of the second layer 20, so that one of the packaging 11 can pass therethrough and be supported by an interior surface of the cut-outs 24, 38.

In an alternative embodiment, the first layer 18 can include a central portion and two wings, and the second layer 20 can extend in a single plane.

Optionally, the third layer 22 can be spaced-apart from (e.g., positioned above a predetermined distance) the second layer 20. The third layer 22 can be positioned proximate to the upper opening of the box 12. The third layer 22 can optionally include a central portion 32, a first wing 34, and a second wing 36. The central portion 32 of the third layer 22 can be positioned between the first wing 34 and the second wing 36 of the third layer 22.

Similar to the first and second layers 18, 20, the third layer 22 can include at least one or a plurality of (e.g., six) spaced-apart cut-outs 40 or openings extending therethrough. Optionally, each cut-out 40 can have a circular shape, or the same shape as the cut-outs 18, 38 of the first and second layers 18, 20. The shape of each cut-out 40 can be configured to match or be at least slightly larger than an outer dimension of one of the packaging 11. For example, each cut-out 40 includes an opening or passageway having a diameter or width that is slightly larger than a diameter or width of one of the plurality of products 11. When placed in the box 12, each cut-out 38 of the second layer 20 can be vertically aligned with one of the cut-outs 40 of the third layer 22, so that one of the packaging 11 can pass therethrough and be supported by an interior surface of the cut-outs 38, 40.

In an alternative embodiment, the first and second layers 18, 20 can each include a central portion and two wings, and the third layer 22 can extend in a single plane.

In one embodiment, the first, second, and third layers 18, 20, 22 are not attached by any mechanical or chemical means. For example, the first layer 18 can optionally be inserted into the box 12 separate from the second and third layers 20, 22. Next, the second layer 20 can optionally be inserted into the box 12 separate from the third layer 22. Next, the third layer 22 can optionally be inserted into the box 12. In an optional alternative embodiment, the first, second, and third layers 18, 20, 22 can be connected (e.g., via tape or adhesive) before being inserted into the box 12. In yet another optional embodiment, the first, second, and third layers 18, 20, 22 can be molded or formed as a single, unitary piece.

Regardless of the number or vertical arrangement of the layers, a pair, a trio, or more (e.g., in the case of additional layers) of the cut-outs of the insert 16 can be vertically aligned to receive at least a portion of one of the packaging 11 in the vertically-aligned pair, trio, or more. This configuration allows the packaging 11 to be held in place with respect to the container 12 and/or prevents the packaging from being damaged.

When the packaging 11 are placed in the cut-outs, a top surface of each packaging can be coplanar with the third layer 22, can be positioned slightly below the top surface of the third layer 22 (as shown in FIG. 1), or can be positioned slightly above the top surface of the third layer 22.

One method of the presently disclosed technology includes placing an insert 16 into a box 12. The method can include placing one packaging 11 into at least one of cut-out 24 or in one set of cut-outs 24, 38, 40 that are vertically aligned. The method can include closing the box 12 and then storing or shipping the box 12.

Another method of the presently disclosed technology includes forming an insert 16 outside of a box 12. The insert 16 can be formed, in one optional embodiment, by bending portions of a third layer 22, bending portions of a second layer 20, placing the second layer 20 on top of the first layer 18, placing the third layer 22 on top of the second layer 20. The method can then include placing the insert 16 into the box.

The following exemplary embodiments further describe optional aspects of the presently disclosed technology and are part of this Detailed Description. These exemplary embodiments are set forth in a format substantially akin to claims, although they are not technically claims of the present application. The following exemplary embodiments refer to each other in dependent relationships as "embodiments" instead of "claims."

1A. A method for preventing or reducing cans being damaged during shipping, the method comprising:

placing each can in a cut-out formed in one or more inserts placed within a container.

2A. The method of embodiment 1A, wherein each cut-out is circular.

1B. A box for storing or shipping a plurality of cans, the box including an insert removable inserted in the box, the insert comprising:

a first layer proximate a bottom of the box, the first layer being planar, the first layer including a plurality of circular, spaced-apart cut-outs extending therethrough;

a second layer spaced-apart from the first layer, the second layer including a central portion, a first wing, and a second wing, the central portion of the second layer being positioned between the first wing and the second wing of the second layer, each cut-out in the second layer being located in the central portion thereof; and a third layer spaced-apart from the second layer, the third layer including a central portion, a first wing, and a second wing, the central portion of the third layer being positioned between the first wing and the second wing of the third layer, each cut-out in the third layer being located in the central portion thereof.

2B. The box of embodiment 1B, wherein the insert is formed of cardboard.

1C. A method for preventing or reducing cans from being damaged during storage or shipping, the method comprising:

placing each can in a cut-out formed in one or more layers placed within a container.

2C. The method of embodiment 1C, wherein the container is a cardboard box.

3C. The method of embodiment 1C or 2C, wherein the one or more layers includes three layers.

4C. The method of embodiment 3C, wherein the three layers includes a first layer proximate a bottom of the container, a second layer spaced-apart from the first layer, and a third layer spaced-apart from the second layer.

1D. A method for preventing or reducing cans from being damaged during storage or shipping, the method comprising:

inserting a first layer of an insert into a container, the first layer including a plurality of spaced-apart cut-outs extending therethrough;

inserting a second layer of an insert into a container, the second layer including a plurality of spaced-apart cut-outs extending therethrough;

inserting a can into one of the cut-outs of the second layer and into one of the cut-outs of the first layer; and closing the container.

1E. A method for preventing or reducing cans from being damaged during storage or shipping, the method comprising:

placing an insert into an interior of a container;

placing a can containing foodstuff into two or more vertically aligned and vertically spaced-apart cut-outs of the insert; and closing the container with the insert and the can therein.

While the presently disclosed technology has been described in detail and with reference to specific examples thereof, it will be apparent to one skilled in the art that various changes and modifications can be made therein without departing from the spirit and scope thereof. It is understood, therefore, that the presently disclosed technology is not limited to the particular embodiments disclosed, but it is intended to cover modifications within the spirit and scope of the present presently disclosed technology as defined by the appended claims.

What is claimed is:

1. A system configured to store or ship a plurality of cans without causing damage to the cans or product therein, the system including a cardboard box and an insert that can be placed into and removed from the box, the insert comprising:

a first layer proximate a bottom of the box, the first layer being planar, the first layer including a plurality of circular, spaced-apart cut-outs extending therethrough, each cut-out in the first layer having a diameter;

a second layer spaced-apart above the first layer, the second layer including a central portion, a first wing attached to one side of the central portion of the second layer, and a second wing attached to an opposing side of the central portion of the second layer, the central portion of the second layer being positioned between the first wing and the second wing of the second layer, when the insert is placed into the box the first and the second wings of the second layer each extending downwardly at an angle between 70-110 degrees with respect to the central portion of the second layer, the second layer including a plurality of circular, spaced-apart cut-outs extending through the central portion thereof, each cut-out in the second layer being located in the central portion thereof, each cut-out in the second layer having a diameter; and a third layer spaced-apart above the second layer, the third layer including a central portion, a first wing attached to one side of the central portion of the third layer, and a second wing attached to an opposing side of the central portion of the third layer, the central portion of the third layer being positioned between the first wing and the second wing of the third layer, when the insert is placed into the box the first and the second wings of the third layer each extending downwardly at an angle between 70-110 degrees with respect to the central portion of the third layer, the third layer including a plurality of circular, spaced-apart cut-outs extending through the central portion thereof, each cut-out in the third layer being located in the central portion thereof, each cut-out in the second layer having a diameter, wherein, when the insert is placed into the box, the insert extends an entire width and length of an interior of the box, and wherein, when the insert is placed into the box, each cut-out in the third layer vertically aligns with one of the plurality of cut-outs in each of the second layer and the first layer such that one can of the plurality of cans can be inserted into a trio of vertically aligned cut-outs to prevent the can from moving relative to the box, and wherein the first, second, and third layers are separable from one another.

2. The system of claim 1, wherein the cut-outs of each of the first, second and third layers are the same size.

3. An insert configured to store or ship a plurality of packaging, the insert being configured to be placed into and removed from a container, the insert comprising:

a first layer that is planar and includes a plurality of circular, spaced-apart cut-outs extending therethrough, each cut-out in the first layer having an opening;

a second layer spaced-apart from the first layer, the second layer including a plurality of circular, spaced-apart cut-outs extending therethrough, each cut-out in the second layer having an opening, and a third layer spaced-apart from both the first layer and the second layer, wherein each cut-out in the second layer vertically aligns with one of the plurality of cut-outs in the first layer such that one packaging of the plurality of packaging can be inserted into a pair of vertically aligned cut-outs, wherein the first, second, and third layers are separable from one another, and wherein the second layer includes a central portion, a first wing attached to one side of the central portion of the second layer, and a second wing attached to an opposing side of the central portion of the second layer, the central portion of the second layer being positioned between the first wing and the second wing of the second layer, each cut-out in the second layer being located in the central portion thereof.

4. The insert of claim 3, wherein the insert further comprises:

the third layer including a central portion, a first wing, and a second wing, the central portion of the third layer being positioned between the first wing and the second wing of the third layer, the third layer including a plurality of circular, spaced-apart cut-outs extending through the central portion thereof, each cut-out in the third layer being located in the central portion thereof, each cut-out in the third layer having a diameter.

5. The insert of claim 4, wherein the second layer is positioned above the first layer, and wherein the third layer is positioned above the second layer.

6. The insert of claim 3, wherein the insert is formed of corrugated cardboard.

7. An insert configured to store or ship a plurality of packaging, the insert being configured to be placed into and removed from a container, the insert comprising:

a first layer that is planar and includes a plurality of circular, spaced-apart cut-outs extending therethrough, each cut-out in the first layer having an opening; and a second layer spaced-apart from the first layer, the second layer including a plurality of circular, spaced-apart cut-outs extending therethrough, each cut-out in the second layer having an opening, wherein each cut-out in the second layer vertically aligns with one of the plurality of cut-outs in the first layer such that one packaging of the plurality of packaging can be inserted into a pair of vertically aligned cut-outs, wherein the first and second layers are separable from one another, and when the insert is placed into the box the first and the second wings of the second layer each extending downwardly at an angle between 70-110 degrees with respect to the central portion of the second layer.

8. The insert of claim 3, wherein the cut-outs of each of the first and second layers have a circular shape and are the same diameter.

9. The insert of claim 3, wherein the container is a cardboard box, and wherein the plurality of packaging are cans containing foodstuff.

* * * * *